US005944354A

United States Patent [19]

Feola

[11] Patent Number: 5,944,354

[45] Date of Patent: Aug. 31, 1999

[54] METHOD AND APPARATUS FOR PREVENTING FRAUD WITH INSTANT GAME TICKETS

[76] Inventor: John Feola, 42 Irving St., Medford, Mass. 02155

[21] Appl. No.: 09/042,840

[22] Filed: Mar. 17, 1998

[51] Int. Cl.[6] ..... B42D 15/00

[52] U.S. Cl. ..... 283/67; 283/901

[58] Field of Search ..... 283/67, 903, 70; 463/17

[56] References Cited

U.S. PATENT DOCUMENTS

| | | | |
|---|---|---|---|
| 3,212,780 | 10/1965 | Jewell | 283/901 |
| 5,118,109 | 6/1992 | Gumina | 283/901 |
| 5,197,764 | 3/1993 | Hicinbothem et al. | 283/81 |
| 5,232,221 | 8/1993 | Sludikoff et al. | 273/139 |
| 5,451,052 | 9/1995 | Behm et al. | 273/139 |
| 5,690,367 | 11/1997 | Fromer | 283/94 |
| 5,772,510 | 6/1998 | Roberts | 463/17 |

*Primary Examiner*—Andrea L. Pitts
*Assistant Examiner*—Adesh Bhargava
*Attorney, Agent, or Firm*—Morse & Altman

[57] ABSTRACT

A method for preventing fraud associated with instant game tickets by permanently alter the ticket to indicate which of the available selections the player wishes to play prior to giving the player the ability to reveal any selections. The ticket has an alteration site, which is a token or tag associated with each selection or a single printed or magnetic region. The alteration site is altered by punching a hole, cutting a notch, marking with ink, or changing the magnetic coding. The ticket may be altered after the player has chosen the selections or the player may be offered a ticket from a set of previously-altered tickets. The ticket may be altered or sold by a person or by a vending machine. The vending machine may allow the player to choose the selections, it may offer the player a choice of previously-altered tickets, or it may give the player a ticket with a random selection chosen.

14 Claims, 7 Drawing Sheets

METHOD AND APPARATUS FOR PREVENTING FRAUD WITH INSTANT GAME TICKETS

BACKGROUND OF THE INVENTION

1. Field of the Invention

The present invention relates to instant tickets used by lotteries and promotions, more particularly, to a method and an apparatus for preventing fraud with instant tickets.

2. The Prior Art

Instant game tickets are popular forms of gambling and entertainment, usually employed by state and national lotteries and by companies doing marketing promotions. There are two basic physical forms for instant game tickets, the pull-tab ticket and the scratch ticket. The pull-tab ticket is typically a sheet of plastic or heavy paper onto which are printed a number of symbols. A second sheet of plastic or paper is bonded over the first sheet so that the symbols are hidden. The second sheet includes perforations that define a hatch over each symbol. The player tears open a hatch to reveal a symbol. The typical scratch ticket is composed of a sheet of plastic or heavy paper on which is printed a number of symbols. The symbols are covered by an opaque, removable coating that can be scratched off to reveal the symbols underneath.

There are two basic categories of instant game tickets based on when and how the winner is determined, the predetermined ticket and the probability ticket. Whether or not a predetermined ticket will be a winner is determined when the ticket is manufactured. For example, a winning number is printed on the ticket and the player reveals all of the playing numbers to see if any of them match the winning number. The player has no choices to make.

In the probability ticket, every ticket has the potential to be a winner. For example, a ticket has five poker hands, one of which is to be chosen and revealed by the player. If chosen poker hand is the highest one on the ticket, the ticket is a winner. If more than one hand is revealed, the ticket is voided. Since there is always a highest poker hand on every ticket, every ticket can win if the player chooses the correct hand. In another example, the player chooses five playing cards from a set of 25 playing cards and if the five chosen cards combine to form one of a predetermined set of poker hands, the ticket is a winner. If at least one combination of the 25 playing cards includes at least one of the predetermined set, every ticket can win if the player chooses the correct five cards.

Because every probability ticket can win, it is a target for fraud. A player will clandestinely determine which selection will be the winner and then reveal only that selection. One popular technique for determining the winning selection is to put a number of pinprick holes that are not visible to casual inspection in a selection cover and then to examine the pinpricked selection through a microscope.

Currently, fraud is minimized by inspecting the ticket after it has been sold and brought back as a winner. One example is an instrument that visually inspects the ticket for microscopic holes. One shortcoming of post-selection inspection is that, as new fraud techniques are created, new detection instruments must be designed and distributed to the many thousands of instant ticket outlets. And this is assuming that the fraud technique is detected by those paying out the winning tickets. So there is not only the expense of designing and distributing new detection instruments, there is the time lag in detecting the fraud technique and the time lag in designing and distributing detection instrument, both of which may be significant.

SUMMARY OF THE INVENTION

An object of the present invention is to provide a method for preventing fraud in the use of probability instant game tickets that does not depend upon the fraud technique.

Another object is to provide a method for preventing fraud that is implemented at the time of receipt of the ticket by the player, rather than at the time of payoff.

The present invention is a method for preventing fraud associated with instant game tickets. The basic method of the invention is to permanently alter the ticket to indicate which of the available selections the player wishes to play prior to giving the player the ability to reveal those, or any other, selections. An instant game ticket includes a plurality of selections, a predetermined number of which are chosen to determine if the ticket is a winning ticket.

The ticket is altered at an alteration site on the ticket from an unaltered state to an altered state. There are several embodiments of the alteration site. The first includes a token associated with each selection. The token is altered by removing or masking the visual pattern of the token. There are several preferred techniques for altering the token, including punching a hole, cutting a notch, and marking with ink.

In the second embodiment of the alteration site, the site is a single region on the ticket that has a visual pattern. The region is altered by removing or masking a portion of the pattern. There are two preferred techniques for altering the token, including punching a hole and marking with ink. The alteration includes an indication of which selection or selections are chosen.

In the third embodiment of the alteration site, the site includes a tag associated with each selection. The preferred technique for altering the tag is to remove it.

In the fourth embodiment of the alteration site, the site is a magnetic strip or dot that has a particular magnetic configuration. The preferred technique for altering the strip is to change the magnetic configuration.

When the ticket is altered is the subject of two different embodiments. In the first, the selections are chosen by the player and the ticket is altered accordingly. In the second embodiment, the player is offered a choice of tickets that have already been altered. Alternatively, a previously altered ticket is randomly chosen for the player.

There are two basic mechanisms for performing the ticket alteration. In the first, the alteration is performed by the human seller of the ticket. The player chooses a selection and tells the seller, who then alters the ticket accordingly and gives it to the player. The second mechanism is by a vending machine. In one vending machine, the machine displays an unaltered ticket to the player. The player then chooses the selections he wishes to play and informs the machine. The machine alters the ticket accordingly and gives the ticket to the player. In a second vending machine, the machine displays a set of previously-altered tickets to the player, where each ticket has a different selection chosen. The player then chooses the ticket he wishes to play and informs the machine, and the machine gives the ticket to the player. In a third vending machine, the machine gives the player a ticket with a selection already chosen at random.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

The present invention is a method for preventing fraud associated with instant game tickets. The basic method of the invention is to permanently alter the ticket to indicate which of the available selections the player wishes to play prior to giving the player the ticket.

Figure 1:
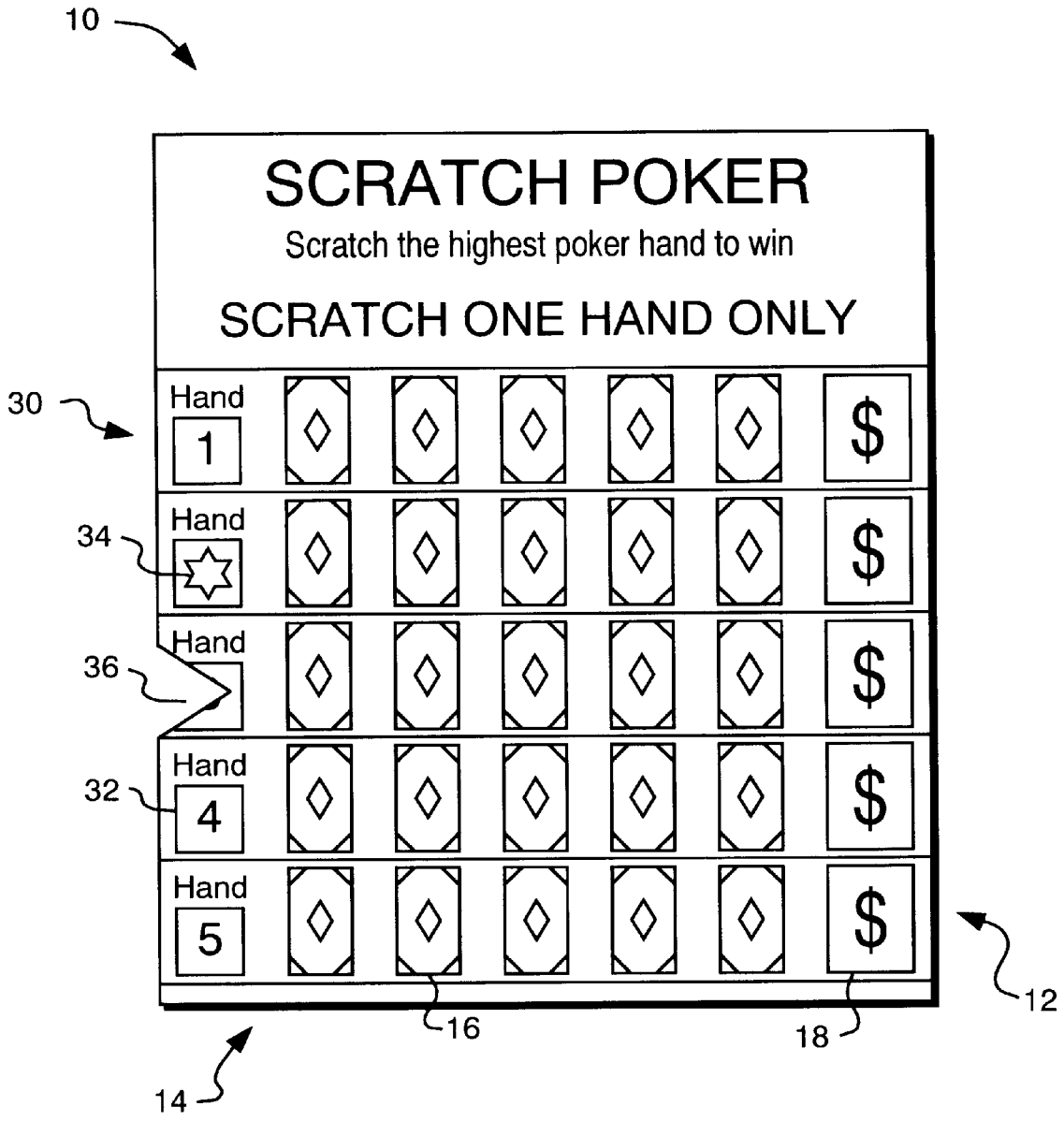
FIG. 1 is a view of an independent-selection probability instant game ticket implementing an embodiment of the present invention with several variations.

A typical independent-selection probability instant game ticket 10 implementing the present invention is shown in FIG. 1. Each selection 12 includes a set 14 of hidden symbols 16, where the player chooses at least one of the selections. It is called an independent-selection ticket because any one selection is independent of any other selection, that is, it is only necessary that the player choose one selection to play the game. If the rules of the particular game permit, it is possible that a player may choose more than one selection in order to increase the odds of winning. Any game can be played that requires the player to choose from at least two selections, where at least one of the selections is a winner. The form and arrangement of the symbols 16 is determined by the game being played. In the example of FIG. 1, each selection 12 consists of a five-card poker hand, in which case the symbols 16 represent playing cards. The game is won by choosing the selection representing the highest poker hand. In another example, each selection consists of a set of dice, in which case each symbol represents a die face. The game is won by choosing the selection representing the highest sum of the dots on the die faces. Each selection 12 also includes a symbol indicating whether or not it is the winning selection and a symbol representing the prize. These two symbols may be integrated into one symbol 18, as shown in FIG. 1.

Figure 2:
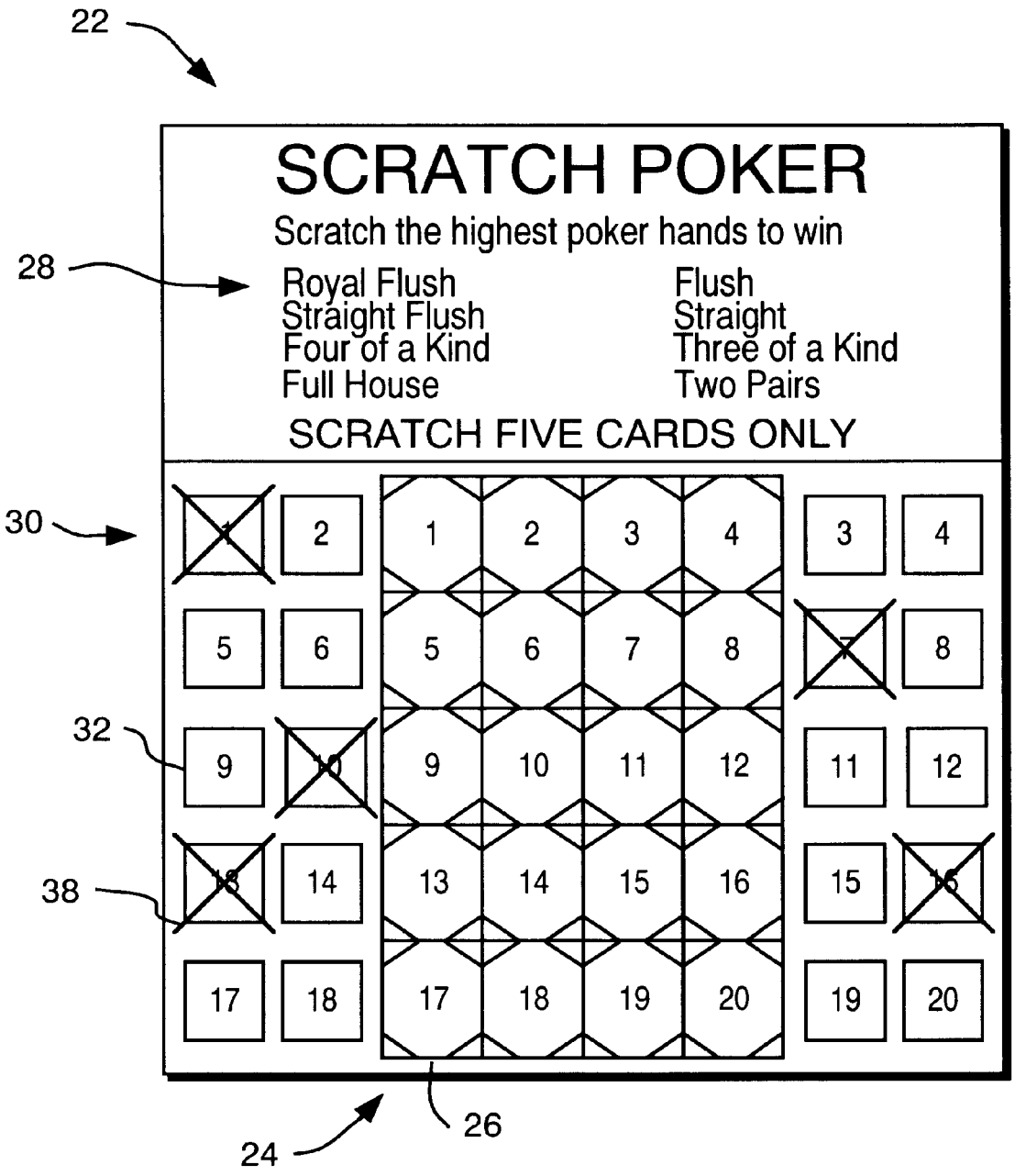
FIG. 2 is a view of a multiple-selection probability instant game ticket implementing another embodiment of the present invention with several variations.

A typical multiple-selection probability instant game ticket 22 implementing the present invention is shown in FIG. 2. Each selection 24 includes a hidden symbol 26. It is called a multiple-selection ticket because at least two selections 24 must be chosen and combined to determine if the ticket 22 is a winner. The number of selections that must be chosen and the form and arrangement of the selection symbols 26 are determined by the game being played. In the example of FIG. 2, each symbol 26 represents a single playing card. The game is played by choosing five selections 24 and combining them into a poker hand. If the combination poker hand matches one of a predetermined set of poker hands 28, the ticket 22 is a winner. The predetermined set of winning combinations 28 and their associated prizes are indicated on the ticket 22.

As indicated above, the present invention is a method whereby the ticket is permanently altered to reflect which one or ones of the available selections the player wishes to play prior to giving the player the ability to reveal those, or any other, selections. The permanent alteration of the ticket is performed on an alteration site 30 of the ticket. The site 30 has two states, an unaltered state and an altered state. As indicated above, the alteration of the site 30 is permanent, that is, the change from the unaltered state to the altered state is substantially irreversible, "substantially" because, while it may be possible to return to the unaltered state, it is very difficult to do so.

There are several preferred embodiments of the alteration site 30 and means by which they are altered. In the first embodiment, shown in FIGS. 1 and 2, the site 30 includes a token 32 associated with each selection. The token 32 is designed so that it is obviously associated with the selection 12, 24 that it represents. This feature prevents fraud to some degree by removing a source of contention as to which selection was actually chosen by the player. The token 32 is a visual pattern printed or otherwise formed on the ticket. The pattern can be as simple as a dot, words, or number, or as complex as an intricate pattern of lines. The token 32 is altered by removing or masking a portion of the symbol. The more intricate the symbol, the more difficult it is to reverse the alteration.

One preferred technique for altering the token 32 is to remove a portion of the token 32. One example is to punch a hole in the token 32, where the puncher removes a portion of the ticket, as at 34 of FIG. 1 showing a star-shaped hole. The shape of the hole can act as an additional deterrent, for example, by making the hole into the shape of the selection number. Merely making a hole without removing a portion of the ticket could invite fraud by making it relatively easy to repair. Alternatively, if the token 32 is adjacent to the edge of the ticket, a notch can be cut out of the edge of the ticket, as at 36.

Another preferred technique contemplated by the present invention to alter the token 32 is to place a mark on the token 32 with a permanent ink, as at 38. The size of the mark must be such that it is unambiguous and that there is no credible argument that the token 32 is not marked. Any form of mark that leaves a permanent mark is possible.

Figure 3:
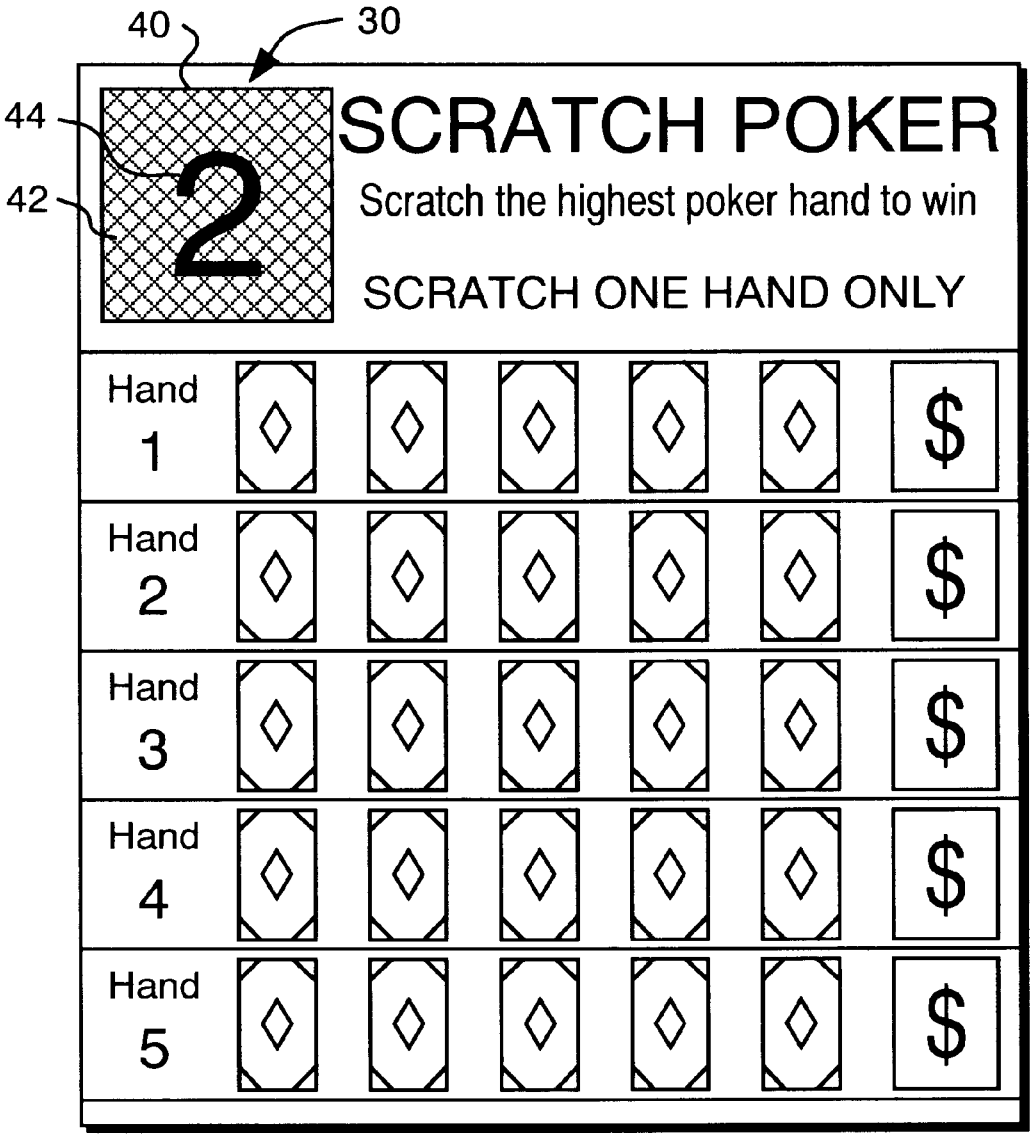
FIG. 3 is a view of a probability ticket implementing another embodiment of the present invention.

In the second embodiment of the alteration site 30, shown in FIG. 3, the site 30 is a single region 40 on the ticket. Alternatively, there are several such regions, the common thread being that there are fewer regions than there are selections, so that there is not a reciprocal one-to-one relationship between a region and a selection. Preferably, the region 40 includes a visual pattern 42 printed or otherwise formed on the ticket, as described above. The region 40 is altered by removing or masking a portion of the pattern.

The two preferred techniques for altering the region 40 are removing a portion of the region 40 and marking the region 40 with permanent ink. One example of removing a portion of the region 40 is to punch a hole in the region 40, where the puncher removes a portion of the ticket. When this technique is used, the hole should be shaped to indicate the selection chosen, for example, by making the hole into the shape of the selection number. One example of marking the region 40 is shown in FIG. 3 as putting the selection number in the region 40, as at 44.

Figure 4:
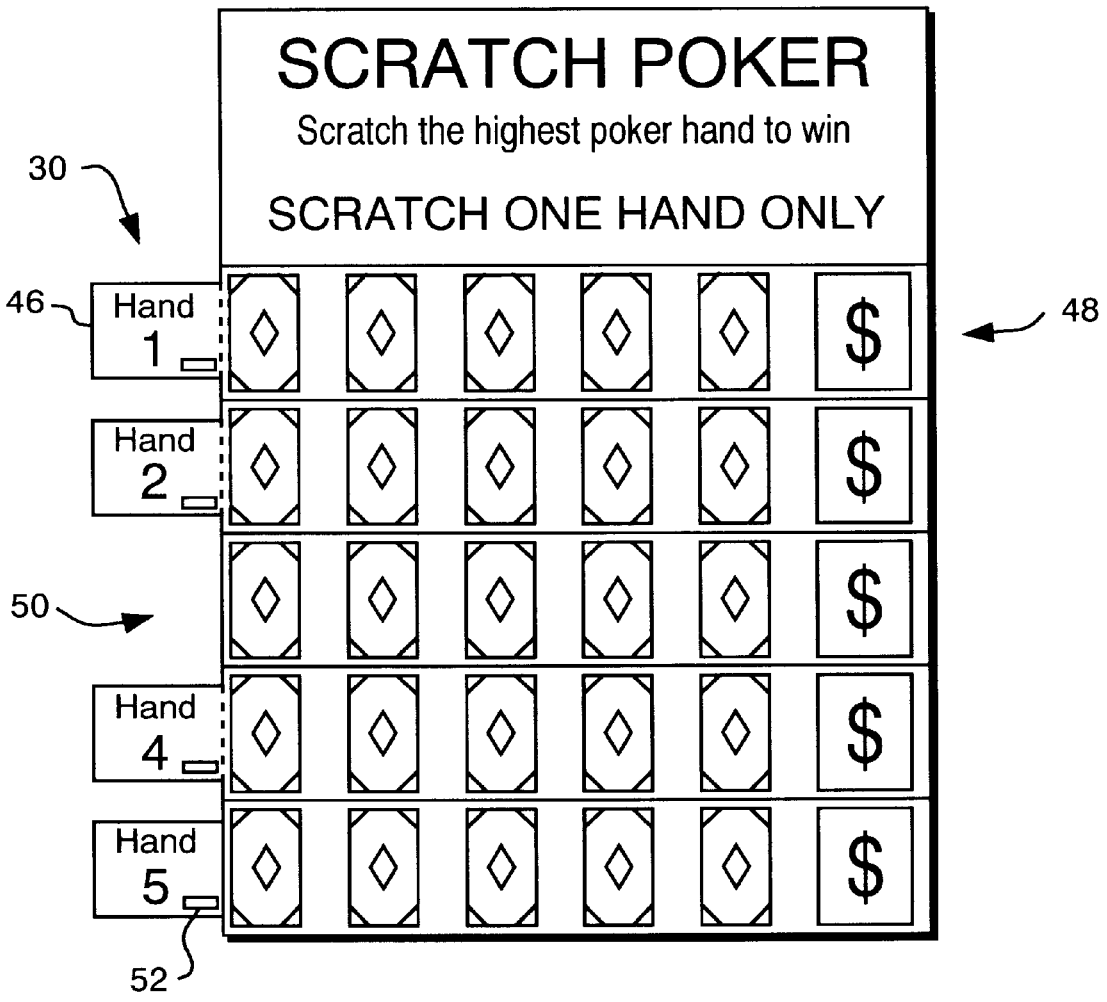
FIG. 4 is a view of a probability ticket implementing another embodiment of the present invention.

In the third embodiment of the alteration site 30, shown in FIG. 4, the site 30 includes a tag 46 associated with each selection 48. The tag 46 is designed so that it is obviously associated with the selection 48 that it represents. This feature prevents fraud to some degree by removing a source of contention as to which selection was actually chosen by the player.

The preferred technique for altering the tag 46 is to remove the tag 46, as at 50. Consequently, the chosen selections will be without their associated tags. This technique provides the possibility of additional security, by including on each tag an identifier 52 that associates it with a particular ticket, such as by serial number. The removed tags are retained for later verification. If the player returns that ticket claiming it as a winning ticket, the serial number and revealed selections can be checked against the identifier 52 on the retained tags.

In the fourth embodiment of the alteration site, the site is a magnetic strip or dot that has a particular magnetic configuration. The preferred technique for altering the strip is to change the magnetic configuration.

Figure 5:
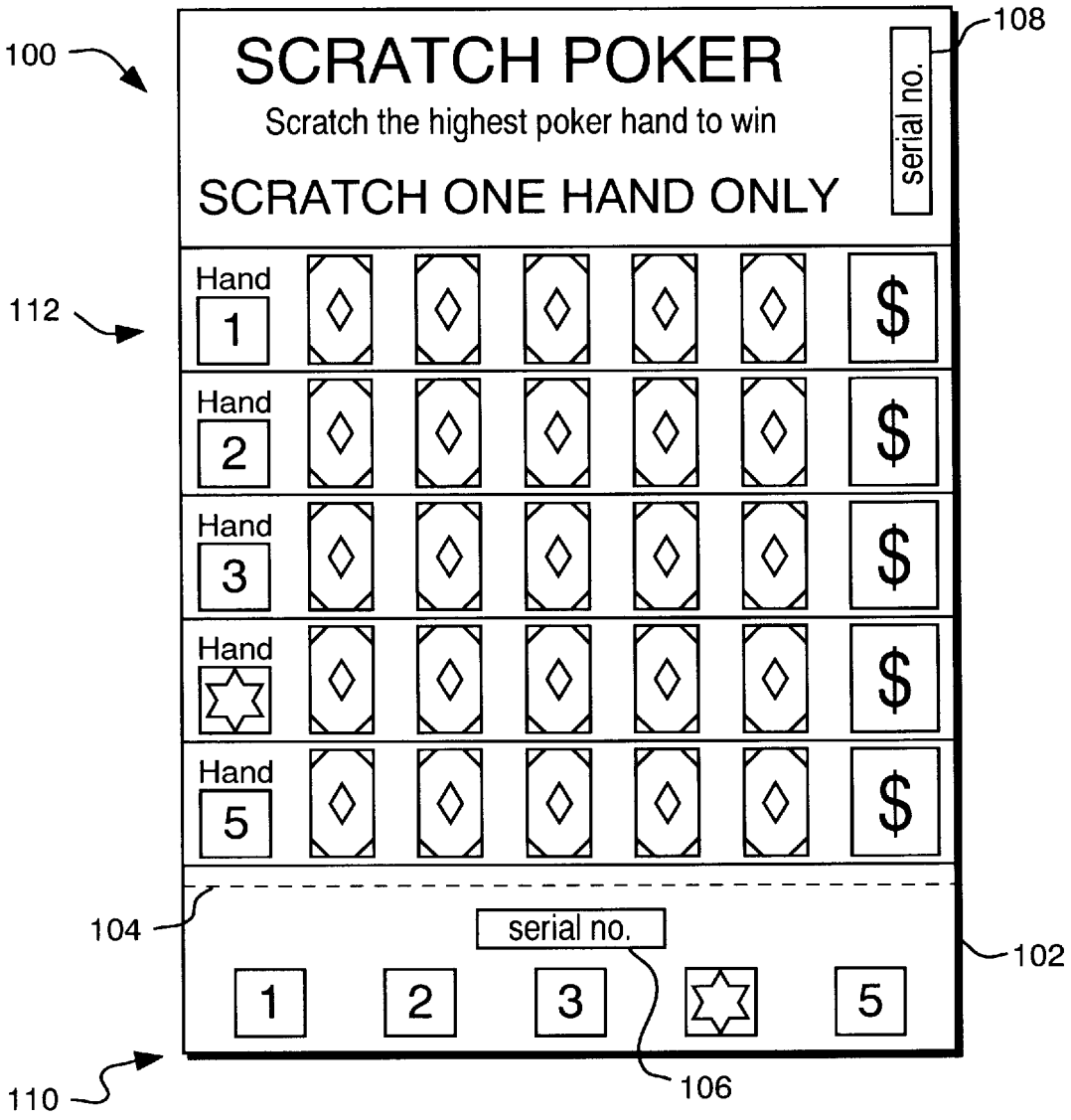
FIG. 5 is a view of a probability ticket implementing an optional enhancement of the present invention.

One option available with the present invention and shown in FIG. 5, is to provide the ticket 100 with a strip 102 that is removed along a perforation 104 and retained prior to giving the player the ticket 100. The strip 102 includes an indication of which selections are chosen 110, essentially the same information as the alteration site 112. The strip 102 also includes an identifier 106 that is a duplicate of the identifier 108 assigned to the ticket 100, such as a serial number. If the player returns the ticket claiming it as a winning ticket, the ticket identifier 108 and revealed selections can be checked against the strip identifier 106.

The present invention requires that the ticket is altered prior to giving the player the ability to reveal the selections. The time that the ticket is altered is the subject of two different embodiments. In the first embodiment, the player chooses the selection or selections to be played and the ticket is altered accordingly. In other words, the selections are chosen by the player after the ticket is made available to the player. In the second embodiment, the player is offered a choice of tickets that have already been altered. In other words, the selections are chosen and the ticket altered before the ticket is made available to the player. For example, if there are five selections, the player is offered five tickets, each with a different selection chosen. Alternatively, the player is offered a large number of tickets, so he can choose amongst several tickets that have the same ticket alteration. Alternatively, a randomly altered ticket is chosen for the player.

The present invention contemplates any feasible mechanism for making the ticket alteration, and there are two basic mechanisms for doing so. In the first, the alteration is performed by the human seller of the ticket. The tickets are kept available to the seller, for example, in a dispenser behind a store counter. The player chooses a selection and tells the seller, who then alters the ticket accordingly and gives it to the player. This mechanism is the easiest to implement, but has several potential problems. For example, the seller may alter the wrong selection, or the player, after determining that the ticket is not a winner, may claim that the seller altered the wrong selection. Or the seller may alter the ticket in such a way that it is ambiguous as to which token is altered.

Figure 6:
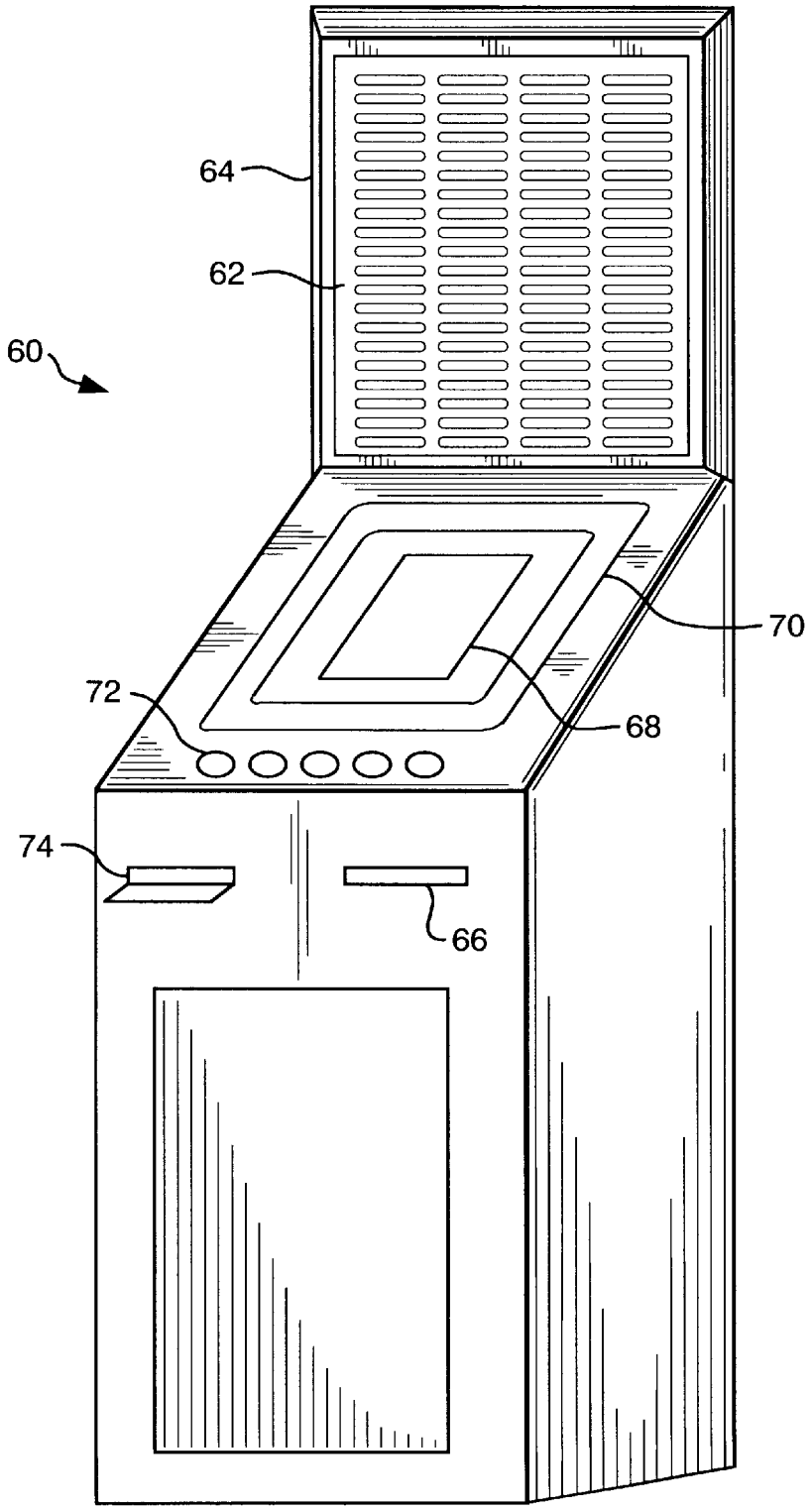
FIG. 6 is a perspective view of one embodiment of a vending machine implementing the present invention.
Figure 7:
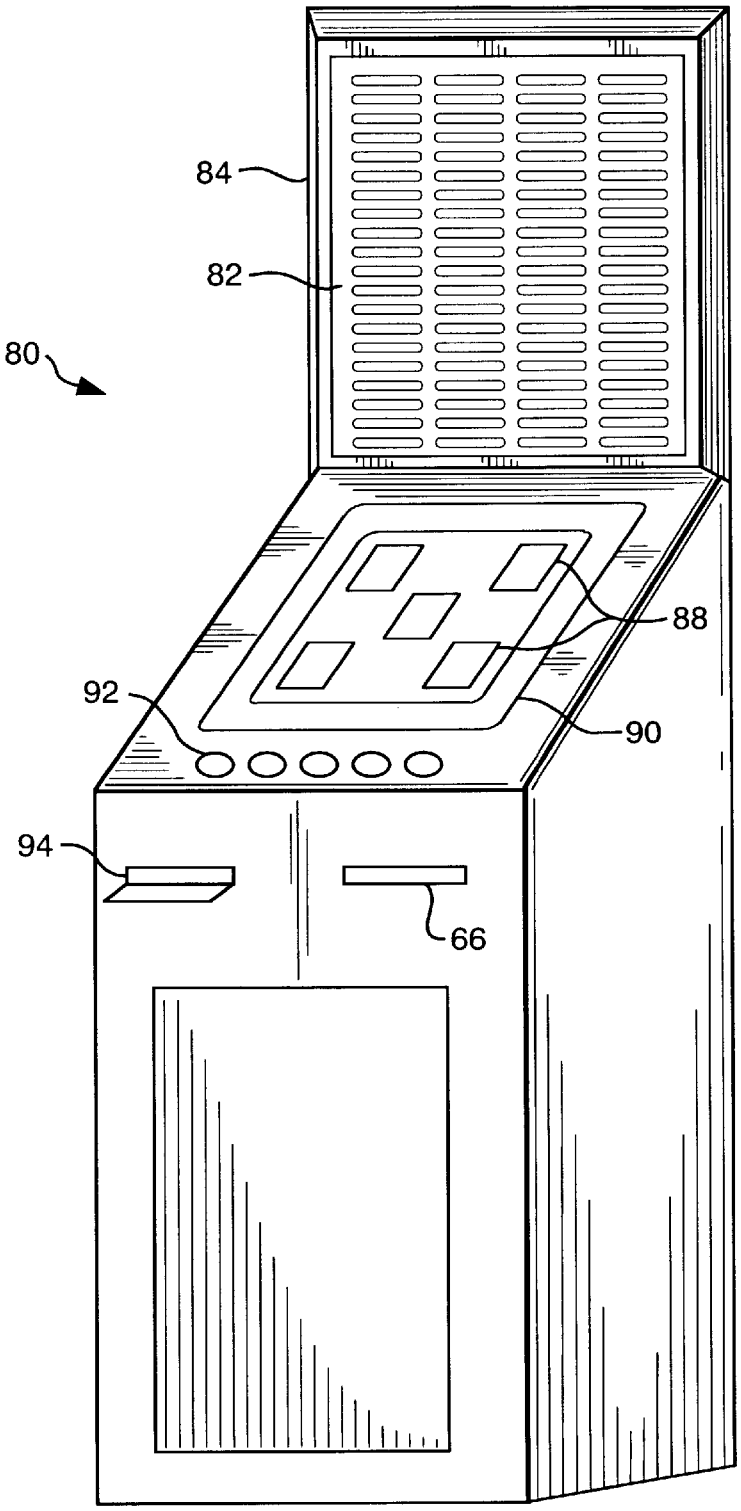
FIG. 7 is a perspective view of another embodiment of a vending machine implementing the present invention.

The second basic mechanism for making the ticket alterations is by a vending machine, examples of which are shown in FIGS. 6 and 7. In the vending machine 60 of FIG. 6, the tickets 62 are kept in a storage area 64 until a player inserts money or equivalent into an inlet 66 of the machine 60. The machine 60 then makes an unaltered ticket 62 available by displaying it to the player. In one configuration, as in FIG. 6, the actual ticket 62 is not displayed, but a representation of the ticket 68 is displayed on a video screen 70. In another configuration, not shown, the actual ticket 62 is shown to the player. The player chooses the selections on the ticket 62 he wishes by some means, such as pressing a button 72 on the machine 60 or touching particular locations on the video screen 70. The vending machine 60 then alters the ticket appropriately in one of the ways described above. Finally, the machine 60 ejects the altered ticket for the player to take, for example, through a slot 74 or in a tray.

In the vending machine 80 of FIG. 7, like that of FIG. 6, the tickets 82 are kept in storage 84 until a player inserts money or equivalent into an inlet 86. Then a number of tickets are made available to the player by displaying them to the player. Either the actual tickets or a video representation 88 of the tickets, each having a different selection already chosen and the ticket altered appropriately, are displayed. The number of tickets displayed is typically the same as the number of selections on an individual ticket 82. The player then indicates to the machine 80 which ticket he wants, for example, by pressing a button 92 or touching the video screen 90, and the machine 80 ejects the altered ticket for the player to take, for example, through a slot 94 or in a tray.

In an alternative to the vending machine of FIG. 7, the vending machine ejects a ticket with a random selection already chosen. In this machine, there is no need for a display of the ticket or of a means to select which ticket to eject.

Thus it has been shown and described a method for preventing fraud with instant tickets which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A method of preventing fraud with probability instant game tickets, said method comprising:

(a) making a probability ticket available to a player, said ticket having a plurality of selections and an alteration site, each of said selections including a hidden portion, and said alteration site having an initial unaltered state;

(b) choosing at least one of said selections;

(c) altering said alteration site from said unaltered state to an altered state to indicate which of said selections are chosen, said altering being performed prior to giving said player an ability to reveal said hidden portions, and said altering being substantially irreversible; and (d) giving said player said ability to reveal said hidden portions after said altering of said alteration site.

2. The method of claim 1 wherein said alteration site includes a visual token associated with each of said selections and said altering is performed on said tokens associated with said chosen selections.

3. The method of claim 2 wherein said altering of said alteration site includes physical removal of a portion of said token.

4. The method of claim 3 wherein said physical removal includes forming a hole in said ticket at said token.

5. The method of claim 3 wherein said token is located adjacent to an edge of said ticket and said physical removal includes forming a notch in an edge of said ticket at said token.

6. The method of claim 2 wherein said altering of said alteration site includes marking said token with permanent ink.

7. The method of claim 1 wherein said alteration site includes a single visual region and said altering is performed on said region.

8. The method of claim 7 wherein said altering of said alteration site includes forming a hole in said ticket at said region.

9. The method of claim 7 wherein said altering of said alteration site includes marking said region with permanent ink.

10. The method of claim 1 wherein said alteration site includes a tag associated with each of said selections and said altering of said alteration site includes removing said tags associated with said chosen selections.

11. The method of claim 1 wherein said ticket is provided to a vendor, then said ticket is made available to said player by said vendor, then said chosen selections are chosen by said player, and then said alteration site is altered by said vendor.

12. The method of claim 11 wherein said vendor is a person.

13. The method of claim 11 wherein said vendor is a vending machine.

14. The method of claim 1 wherein said chosen selections are chosen and said alteration site is altered prior to said ticket being made available to said player.

* * * * *